US006558274B1

(12) United States Patent
Shimosaka

(10) Patent No.: US 6,558,274 B1
(45) Date of Patent: May 6, 2003

(54) SOLID GOLF BALL

(75) Inventor: Hirotaka Shimosaka, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 50 days.

(21) Appl. No.: 09/635,619

(22) Filed: Aug. 10, 2000

Related U.S. Application Data

(60) Provisional application No. 60/149,462, filed on Aug. 19, 1999.

(30) Foreign Application Priority Data

Aug. 19, 1999 (JP) ..... 11-232621

(51) Int. Cl.[7] ..... A63B 37/14
(52) U.S. Cl. ..... 473/351; 473/378
(58) Field of Search ..... 473/378, 379, 473/380, 381, 382, 383, 384

(56) References Cited

U.S. PATENT DOCUMENTS 1,418,220 A * 5/1922 White ..... 473/384
4,560,168 A * 12/1985 Aoyama
4,787,638 A * 11/1988 Kobayashi ..... 473/383
4,979,747 A * 12/1990 Jonkouski
5,016,887 A * 5/1991 Jonkouski
5,033,750 A * 7/1991 Yamagishi et al.
5,158,300 A * 10/1992 Aoyama
5,338,039 A * 8/1994 Oka et al.
5,470,076 A * 11/1995 Cadorniga ..... 473/379
5,735,757 A * 4/1998 Moriyama
5,857,925 A * 1/1999 Sullivan et al.
5,902,193 A * 5/1999 Shimoshaka et al.
6,010,442 A * 1/2000 Lemons et al. ..... 473/384
6,039,660 A * 3/2000 Kasashima et al.
6,056,650 A * 5/2000 Yamagishi et al.
6,066,055 A * 5/2000 Nishino ..... 473/378
6,213,898 B1 * 4/2001 Ogg

* cited by examiner

*Primary Examiner*—Paul T. Sewell
*Assistant Examiner*—Nini Legesse
(74) *Attorney, Agent, or Firm*—Sughrue Mion, PLLC

(57) ABSTRACT

A solid golf ball having a plurality of dimples formed in its surface is characterized in that at least 70% of the entire dimples have a point of inflection at a position of 75 to 90% of their depth, and the overall dimple volume proportion is 0.7 to 0.9%.

11 Claims, 4 Drawing Sheets

SOLID GOLF BALL

CROSS REFERENCE TO RELATED APPLICATION

This application is an application filed under 35 U.S.C. §111(a) claiming benefit pursuant to 35 U.S.C §119(e)(i) of the filing date of the Provisional Application No. 60/149,462 filed on Aug. 19, 1999 pursuant to 35 U.S.C. §111(b).

BACKGROUND OF THE INVENTION

1. Field of the Invention

This invention relates to solid golf balls.

2. Prior Art

It is generally believed that solid golf balls are superior in flight distance performance to wound golf balls, and solid golf balls are widely used in the recent years. Solid golf balls have better flight performance than wound golf balls when hit in the low head speed region, but tend to be rather inferior to wound golf balls in initial velocity and hence, flight distance when hit in the high head speed region, especially the region of head speeds in excess of 48 m/s.

SUMMARY OF THE INVENTION

The invention is an improvement in the above-described circumstances, and an object of the invention is to provide a solid golf ball capable of exerting better flight performance than wound golf balls not only in the low head speed region, but also in the high head speed region of head speeds in excess of 48 m/s.

To attain the above object, the invention provides a solid golf ball as defined below.

(1) A solid golf ball having a plurality of dimples formed in its surface, characterized in that at least 70% of the entire dimples have a point of inflection at a position of 75 to 90% of their depth, and the overall dimple volume proportion is 0.7 to 0.9%.

(2) The solid golf ball of (1) having dimples of at least three types which are different in diameter and dimples of at least two types which are identical in diameter, but different in depth, wherein the total number of dimples is 360 to 540.

(3) The solid golf ball of (1) or (2) comprising a solid core formed of a rubber composition to a diameter of 34 to 40 mm and a cover enclosing the core.

(4) The solid golf ball of (3) wherein the cover has an inside cover of 1.0 to 2.0 mm thick and an outside cover of 1.0 to 2.0 mm thick formed of a thermoplastic polyurethane elastomer.

According to the invention, at least 70% of the entire dimples are, as viewed in elevational cross section taken at the center of the dimple, of dual dimple shape having a point of inflection at a position corresponding to 75 to 90% of their depth. In addition to the location of a point of inflection at such a deep position, the overall dimple volume proportion is set at 0.7 to 0.9%. The golf ball is then given better flight performance than prior art wound golf balls, even in a high head speed region in excess of 48 m/s. Also, by selecting the combination of dimple types to be a combination of dimples of at least three types which are different in diameter with dimples of at least two types which are identical in diameter, but different in depth, and the total number of dimples to be 360 to 540; by designing the solid golf ball structure as comprising a solid core formed of a rubber composition to a diameter of 34 to 40 mm and a cover enclosing the core; and by designing the solid golf ball structure such that the cover has an inside cover of 1.0 to 2.0 mm thick and an outside cover of 1.0 to 2.0 mm thick formed of a thermoplastic polyurethane elastomer, better flight performance in the high head speed region is ensured. Especially when some dimples are made deeper, the difference in flight distance between pole hitting and seam hitting is minimized so that the ball has improved symmetry.

DETAILED DESCRIPTION OF THE INVENTION

Now the present invention is described in further detail.

The solid golf ball of the invention has a solid core and a cover wherein a plurality of dimples are formed in the cover surface.

Here at least 70%, preferably at least 80%, more preferably at least 90% of the entire dimples have a point of inflection at a position of at least 75%, preferably at least 78%, more preferably at least 80% and up to 90%, preferably up to 88%, more preferably up to 87% of their depth.

Figure 1:
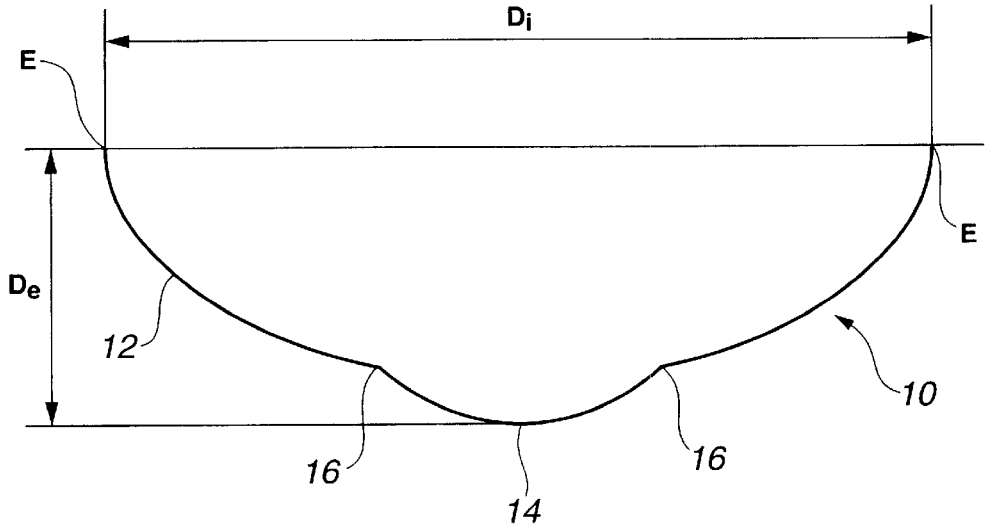
FIG. 1 is a diagram illustrating a dimple shape according to the present invention in an understandable manner.

FIG. 1 illustrates the dimple for better understanding. In an elevational cross section taken at the center of a dimple 10, the dimple has an integrally or contiguously joined shape including a first dimple portion 12 of generally semi-circular or semi-ellipsoidal shape and a second dimple portion 14 of generally semi-circular or semi-ellipsoidal shape with a smaller diameter. The second dimple portion 14 is joined to the first dimple portion 12 at a position corresponding to 75 to 90% of the. depth De of the dimple 10 whereby a point of inflection 16 is positioned at 75 to 90% of the dimple depth.

The dimple having a point of inflection is configured by joining the downwardly convex first dimple portion 12 to the downwardly convex second dimple portion 14 such that both the portions are smoothly connected at the joint. When the cross-sectional shape of the dimple is expressed by a function, the point of inflection 16 is given by the point of inflection of that function. It is noted that the golf ball may also have a point of inflection around the dimple edge due to the influence of paint coating, but this point of inflection is not the point of inflection referred to herein.

Figure 2:
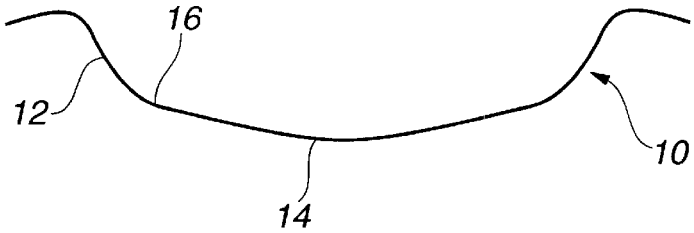
FIG. 2 is a cross-sectional view showing one exemplary dimple shape according to the invention.

As described above, FIG. 1 illustrates the dimple shape according to the invention in an understandable manner. What is shown in FIG. 2 is one example of the actual dimple shape according to the invention.

It is noted that although such a dual dimple shape is known in the art as disclosed in JP-A-60-163674, the prior art dual dimples of this type have a point of inflection at a relatively shallow position.

If the point of inflection is at a shallower position outside the above-defined range, the ball flies with a rather skying trajectory immediately after launching and as a consequence of skying, starts to fall from a higher position, failing to gain a run. Inversely, if the point of inflection is at a deeper position outside the above-defined range, the ball flies with a low trajectory immediately after launching, but the ball speed declines prior to the start of fall, failing to extend a carry.

If the number of dimples having a point of inflection within the above-defined range is small relative to the entire number of dimples, the ball in flight encounters a greater air resistance and becomes unlikely to extend both the carry and run.

Also, according to the invention, the overall dimple volume proportion $V_R$ should be at least 0.70%, preferably at least 0.75%, further preferably at least 0.77% and up to 0.90%, preferably up to 0.82%, further preferably up to 0.80%. If the overall dimple volume proportion $V_R$ is too low, the ball flies with a skying trajectory, failing to gain a run. Inversely, if $V_R$ is too high, the ball flies with a too low trajectory, failing to gain a carry.

The overall dimple volume proportion $V_R$ is determined from the following equation:

$$V_R = \frac{V_S}{\frac{4}{3}\pi R^3} \times 100$$

wherein $V_S$ is the sum of dimple space volumes each defined below a plane circumscribed by the edge of each dimple, and R is a radius of the ball.

Figure 3:
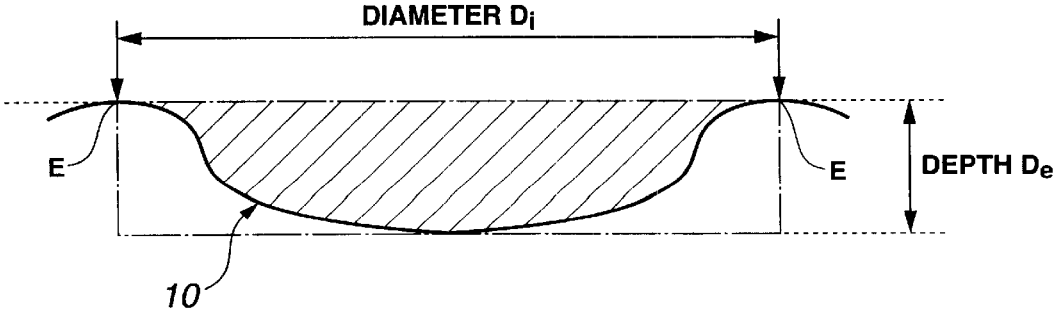
FIG. 3 is a diagram illustrating a dimple shape according to the present invention.

According to the invention, in an elevational cross section taken at the center of the dimple 10 as shown in FIG. 3 wherein the left and right highest points in the figure are positioned on a horizontal line and these highest points are designated dimple edges E and E, the dimple 10 has a diameter Di which is equal to the distance between the dimple edges E and E. The dimple 10 has a depth De which is equal to the distance from a line segment connecting the edges E and E to the deepest bottom of the dimple. Then the dimple has a volume V which is the volume of a dimple portion delimited by the edges.

The shape of dimples used herein is generally circular in plane. Preferably the dimples have a diameter of at least 2.4 mm, more preferably at least 3.0 mm, further preferably at least 3.3 mm and up to 4.6 mm, more preferably up to 4.4 mm, further preferably up to 4.2 mm. Preferably the dimples have a depth of at least 0.08 mm, more preferably at least 0.10 mm, further preferably at least 0.12 mm and up to 0.22 mm, more preferably up to 0.20 mm, further preferably up to 0.19 mm.

The total number of dimples (n) is from 360 to 540. More preferably, the total number of dimples is at least 380, further preferably at least 390 and at most 450, further preferably at most 400.

Preferred for the dimples used herein are combinations of dimples of plural types, typically at least three types, more preferably at least four types which are different in diameter and up to six types, especially up to five types which are different in diameter. The dimples having an identical diameter are preferably dimples of at least two types, more preferably two to four types, especially two or three types which are different in depth. Therefore, combinations of dimples of at least four types, more preferably at least five types and up to twelve types, more preferably up to eight types, further preferably up to six types which are different in diameter and depth are preferable.

Such combinations of dimples ensure that the ball has excellent flight performance in the head speed region in excess of 48 m/s. Especially, the provision of dimples which are identical in diameter, but different in depth is effective in minimizing the difference in flight distance between pole hitting and seam hitting and improving symmetry.

For the arrangement of the above-described dimples, any well-known technique may be used, and no particular limit is imposed as long as the dimples are evenly distributed. There may be employed any of the octahedral arrangement, icosahedral arrangement, and sphere division techniques of equally dividing a hemisphere into 2 to 6 regions wherein dimples are distributed in the divided regions. Fine adjustments or modifications may be made on these techniques. It is also preferred herein that the dimple surface coverage is 69 to 82%, especially 72 to 77%.

The solid golf ball of the invention may be one comprising a core and a cover as described above. It is preferred from the standpoint of advantageously attaining the object of the invention that a solid core formed of a rubber composition and having a diameter of 34 to 40 mm is enclosed in a cover. In particular, the preferred cover has an inside cover of 1.0 to 2.0 mm thick and an outside cover of 1.0 to 2.0 mm thick formed of a thermoplastic polyurethane elastomer.

The rubber composition used herein is preferably one using polybutadiene as the base. One preferred example of the polybutadiene is 1,4-cis-polybutadiene having at least 40% of cis structure. In the base rubber, natural rubber, polyisoprene rubber, styrene-butadiene rubber or the like may be suitably blended with the polybutadiene, if desired. By increasing the rubber component, the resilience of the golf ball is improved.

Also in the rubber composition, there may be blended a zinc or magnesium salt of an unsaturated fatty acid such as zinc methacrylate or zinc acrylate, or an ester such as trimethylpropane methacrylate as a crosslinking agent. In particular, zinc acrylate is preferably used. The amount of the crosslinking agent blended is preferably from 10 to 30 parts by weight per 100 parts by weight of the base rubber.

In the rubber composition, a vulcanizing agent is usually blended. It is recommended that the vulcanizing agent contains a peroxide in which the temperature giving a half-life period of 1 minute is up to 155° C. The content of the peroxide is at least 30%, especially at least 40% by weight of the entire vulcanizing agent while the upper limit of the content is not critical, but is preferably up to 70% by weight. Such peroxides are commercially available, for example, under the tradename of Perhexa 3M (Nippon Oil and Fats K.K.). The amount of the vulcanizing agent blended is preferably from 0.6 to 2 parts by weight per 100 parts by weight of the base rubber.

Further, if necessary, an antioxidant and zinc oxide or barium sulfate as a filler for specific gravity adjustment may be blended.

The rubber composition may be vulcanized and cured by well-known techniques, producing a solid core. The solid core preferably has a diameter of at least 34 mm, especially at least 35 mm and up to 40 mm, more preferably up to 38 mm, further preferably up to 37 mm.

The inside cover is preferably formed of thermoplastic resins. The thermoplastic resins which can be used in the inside cover include, for example, well-known thermoplastic resins and thermoplastic elastomers. Illustrative examples include nylon, polyarylates, ionomer resins, polypropylene resins, thermoplastic polyurethane elastomers, and thermoplastic polyester elastomers. Exemplary commercially available products include Surlyn AD 8512 (ionomer resin by Dupont), Himilan 1706 and 1707 (ionomer resins by Mitsui Dupont Polychemical K.K.), Rilsan BMNO (polyamide resin by Elf Atochem), and U Polymer U-8000 (polyarylate resin by Unitika K.K.). Ionomer resins are especially preferred.

From the standpoints of resilience and feel, the inside cover preferably has a Shore D hardness of at least 50, especially at least 54 and up to 63, especially up to 60. Its gage (or thickness) is preferably at least 1.0 mm, especially at least 1.4 mm and up to 2.0 mm, especially up to 1.7 mm. With a too small gage, the ball can become less durable whereas a too large gage can lead to a drop of resilience.

From the standpoint of imparting ease of control and stoppage comparable to wound golf balls as previously indicated, the outside cover is preferably formed of a thermoplastic polyurethane elastomer. Here the Shore D hardness of the outside cover is lower than that of the inside cover and is preferably at least 40, more preferably at least 43, further preferably at least 44 and up to 52, more preferably up to 50, further preferably up to 47. The outside cover preferably has a gage of at least 1.0 mm, especially at least 1.4 mm and up to 2.0 mm, especially up to 1.7 mm. A too low Shore D hardness can lead to a drop of resilience and shortage of parting smoothness during ball lo molding whereas a too high Shore D hardness tends to give a hard feel and a lower spin rate upon approach shots. With a too small gage, the ball can become less durable whereas a too large gage can lead to a drop of resilience.

The golf ball of the invention is generally completed as a product by further coating the cover with a paint. It is preferable from the standpoints of feel and resilience that the golf ball of the invention is formed so as to experience a compression deformation (referred to as $\mu$ hardness, hereinafter) of 2.6 to 3.4 mm when the load which varies from an initial load of 10 kg to a final load of 130 kg is applied to the ball. With too low a $\mu$ hardness, the feel, especially upon shots causing significant deformation to the ball such as driver shots can sometimes be hard. Inversely, too high a $\mu$ hardness would sometimes fail to provide sufficient resilience.

The diameter and weight of the golf ball of the invention comply with the Rules of Golf. From the standpoint of improving flight performance, the ball is formed to a diameter of 42.67 to 42.97 mm. The weight is preferably 44.9 to 45.9 grams.

The solid golf balls of the invention exert superior flight performance to wound golf balls in all head speed regions ranging from low to high head speeds.

EXAMPLE

Examples and Comparative Examples are given below for illustrating the invention, but the invention is not limited to the following Examples.

Examples & Comparative Examples

Solid cores were prepared by a conventional process using the compositions shown in Table 1.

Each of the cores was then enclosed in an inside cover and an outside cover as shown in Table 1.

TABLE 1

| | (pbw) | Examples 1, 2 Comparative Example 1 | Example 3 |
|---|---|---|---|
| Core | Polybutadiene | 100.0 | 100.0 |
| | Dicumyl peroxide | 1.2 | 1.2 |
| | Barium sulfate | 13.1 | 18.0 |
| | Zinc white | 5.0 | 5.0 |
| | Antioxidant | 0.2 | 0.2 |
| | Zinc salt of pentachlorothio phenol | 1.0 | 1.0 |
| | Zinc diacrylate | 27.4 | 27.4 |
| | Diameter (mm) | 36.4 | 35.5 |
| Inside cover | Dynalon 6100P | 30.0 | — |
| | Surlyn AD8511 | 35.0 | — |
| | Surlyn AD8512 | 35.0 | — |
| | Surlyn 1557 | — | 50.0 |
| | Surlyn 1605 | — | 50.0 |
| | Titanium dioxide | 5.1 | 2.4 |
| | Gage (mm) | 1.65 | 1.7 |
| | Shore D hardness | 56 | 60 |
| Outside cover | PANDEX TR3080 | 50.0 | — |
| | PANDEX T7298 | 50.0 | 100.0 |
| | Titanium dioxide | 2.7 | 2.7 |
| | Gage (mm) | 1.5 | 1.9 |
| | Shore D hardness | 45 | 50 |

Note

Figure 4:
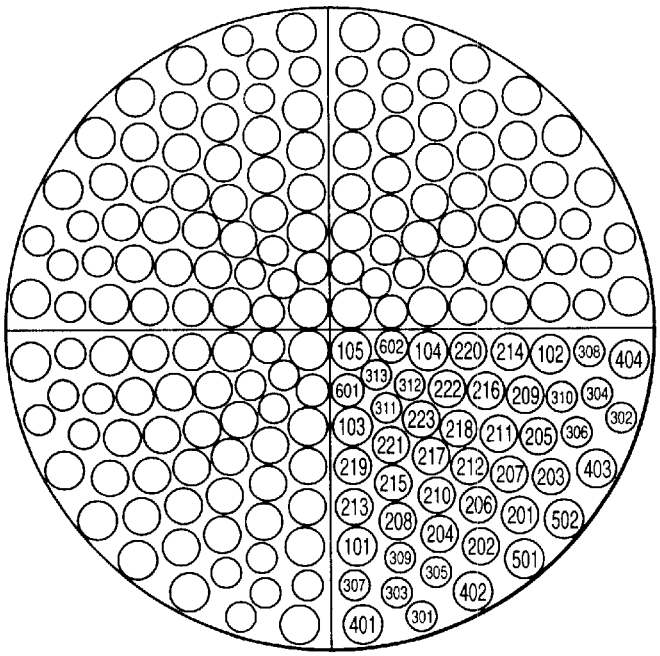
FIG. 4 is a diagram illustrating the arrangement of dimples on the golf balls of Examples 1 and 3 and Comparative Example 1.
Figure 5:
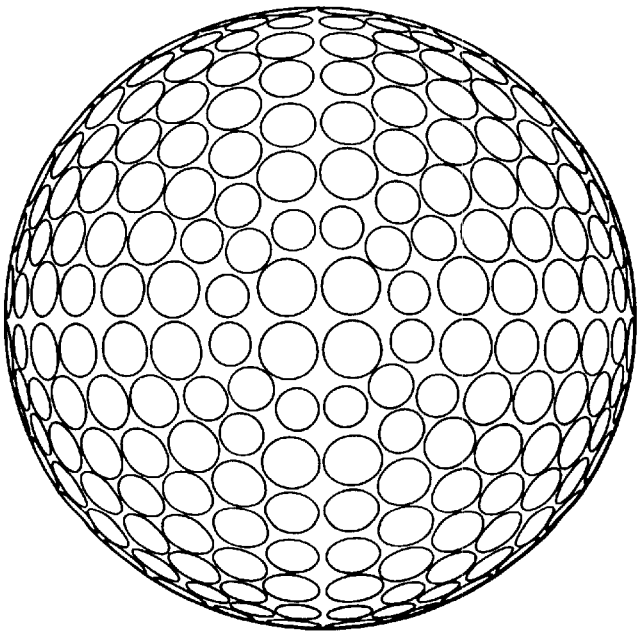
FIG. 5 is a plan view of the same golf ball.
Figure 6:
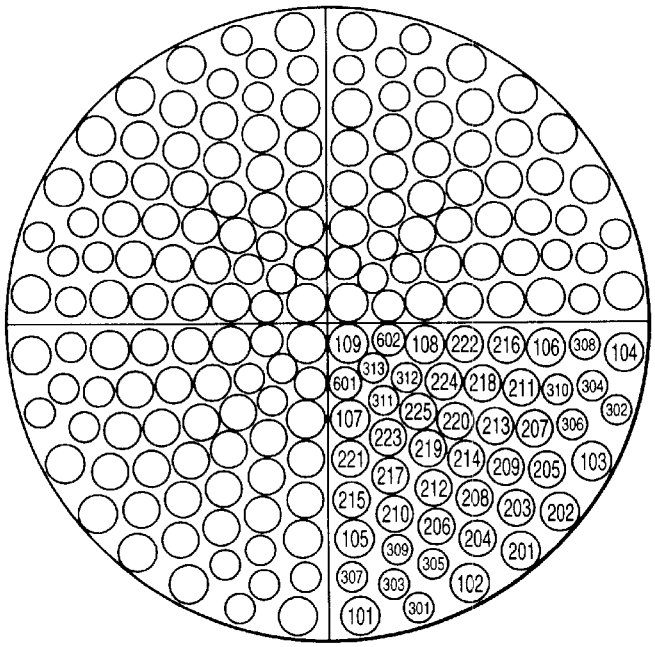
FIG. 6 is a diagram illustrating the arrangement of dimples on the golf ball of Example 2.
Figure 7:
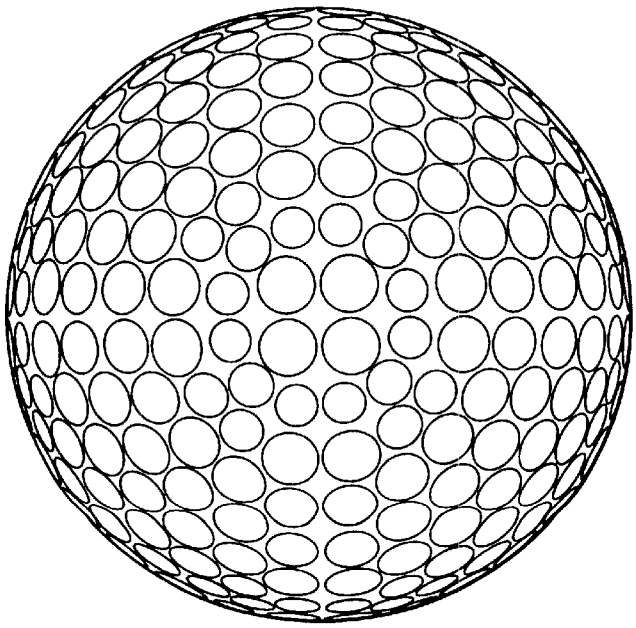
FIG. 7 is a plan view of the same golf ball.

Dynalon: Japan Synthetic Rubber K.K., block copolymer, hydrogenated butadiene-styrene copolymer Surlyn: Dupont, ionomer resin PANDEX: Dainippon Ink & Chemicals K.K., thermoplastic polyurethane elastomer The golf balls of Examples 1 and 3 and Comparative Example 1 were provided on their surface with dimples as shown in Table 1 in the arrangement shown in FIGS. 4 and 5. It is noted that Example 2 employed the arrangement shown in FIGS. 6 and 7. In the figures, the dimples labeled 100s designate dimples (1), the dimples labeled 200s designate dimples (2), and the dimples labeled 300s designate dimples (3) in Table 1 (and so forth).

A flight test was carried out on the thus obtained golf balls by the following procedure. The results are also shown in Table 2.

Flight test

Using a swing robot manufactured by Miyamae K.K., 20 balls of each Example were hit with a driver at a head speed of 50 m/s and with No. 5 iron at a head speed of 38 m/s. An initial velocity, spin rate, elevation angle (angle in height direction relative to the horizontal), carry, total distance, and symmetry were measured. Also, using a sand wedge, an initial velocity and spin rate were measured at a head speed of 19 m/s.

Clubs used

Driver parameters

Head: manufactured by Bridgestone Sports Co., Ltd., J's METAL, loft angle 7.5°, lie angle 57°, SUS630 stainless steel, lost wax process Shaft: Harmotech Pro, HM-70, LK (low kick point), hardness X No. 5 iron parameters Head: manufactured by Bridgestone Sports Co., Ltd., Beam No. 5 iron, loft angle 28°, lie angle 60°

Shaft: Precision Rifle shaft, flex 6.5 (medium kick point),

Sand wedge parameters

Head: manufactured by Bridgestone Sports Co., Ltd., Beam sand wedge, loft angle 56°, lie angle 62.5°

Shaft: Precision Rifle shaft, flex 6.5 (medium kick point),

The symmetry was determined by the following method.

Figure 8A:
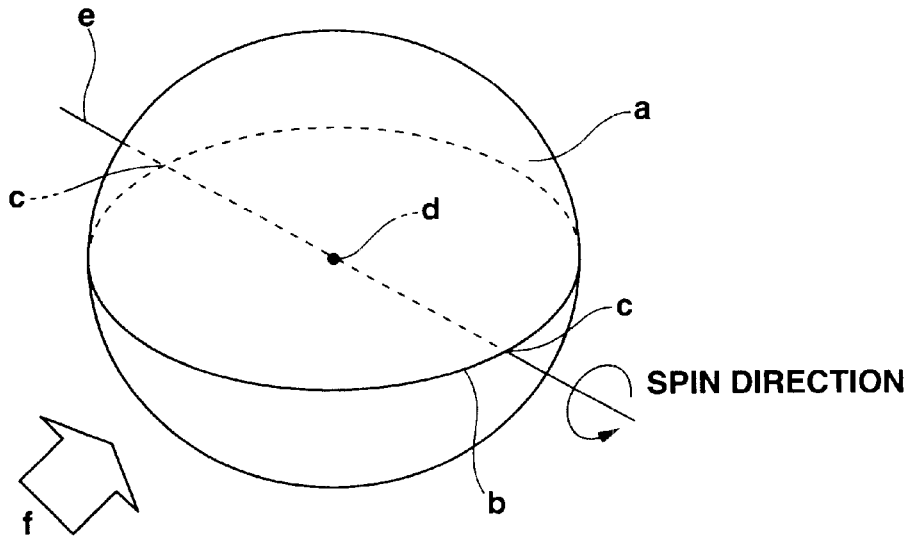
FIG. 8 schematically illustrates the impact direction when a golf ball is hit, FIG. 8(A) corresponding to pole hitting and FIG. 8(B) corresponding to seam hitting.
Figure 8B:
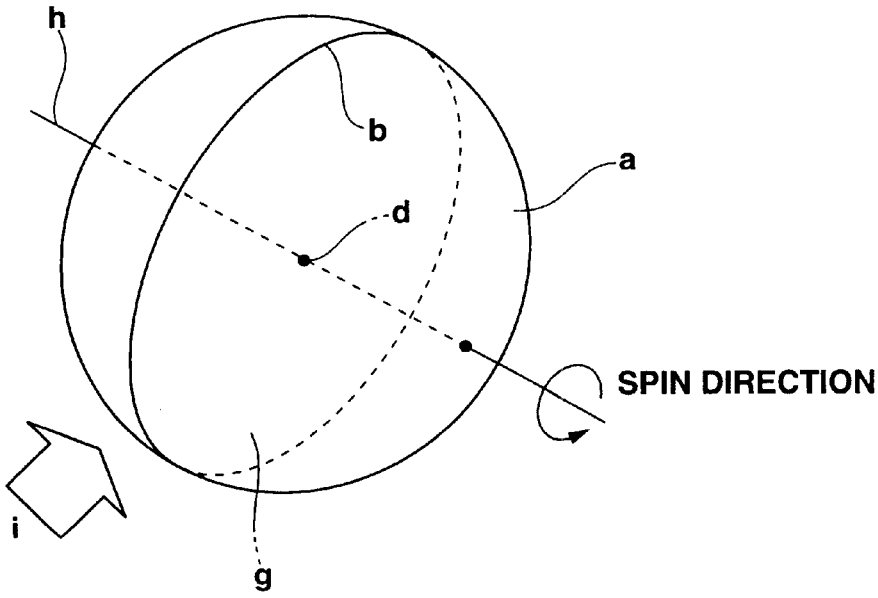

The ball was repeatedly hit in the impact direction (pole hitting) shown in FIG. 8(A) and in the impact direction (seam hitting) shown in FIG. 8(B), from which the difference was determined. More specifically, when a golf ball is hit with a club, the ball is given back spin although the number of revolutions varies with a particular type of club. The ball hitting is generally classified into pole hitting and seam hitting depending on an impact point as shown in FIGS. 8(A) and 8(B). The pole hitting means that the ball (a) is hit at arrow (f) so as to give back spin about a straight line (e) connecting two diametrically opposed points (c, c) on a seam line (b) and a center (d) of the ball (a) as shown in FIG. 8(A). The seam hitting means that the ball (a) is hit at arrow (i) so as to give back spin about a straight line (h) extending perpendicular to a circular plane (g) circumscribed by the seam line (b) and passing the center (d) of the ball (a). Those golf balls showing a less difference are golf balls of improved symmetry that exert a minimized variation in flight performance among different impact points.

TABLE 2

| | Example 1 | Example 2 | Example 3 | Comparative Example 1 | Comparative Example 2 |
|---|---|---|---|---|---|
| Dimple (1) | | | | | |
| Dimple number | 40 | 72 | 40 | 40 | Commercial wound ball |
| Diameter (mm) | 4.12 | 4.12 | 4.12 | 4.10 | |
| Depth (mm) | 0.17 | 0.17 | 0.17 | 0.19 | |
| Volume ($mm^3$) | 1.10 | 1.10 | 1.10 | 1.07 | |
| Position of inflection point (%) | 87 | 87 | 87 | 72 | |
| Dimple (2) | | | | | |
| Dimple number | 184 | 200 | 184 | 184 | |
| Diameter (mm) | 3.88 | 3.88 | 3.88 | 3.92 | |
| Depth (mm) | 0.16 | 0.16 | 0.16 | 0.18 | |
| Volume ($mm^3$) | 0.88 | 0.88 | 0.88 | 0.90 | |
| Position of inflection point (%) | 84 | 84 | 84 | 70 | |
| Dimple (3) | | | | | |
| Dimple number | 104 | 104 | 104 | 104 | |
| Diameter (mm) | 3.14 | 3.14 | 3.14 | 3.08 | |
| Depth (mm) | 0.14 | 0.14 | 0.14 | 0.14 | |
| Volume ($mm^3$) | 0.51 | 0.51 | 0.51 | 0.46 | |
| Position of inflection point (%) | 81 | 81 | 81 | 68 | |
| Dimple (4) | | | | | |
| Dimple number | 32 | — | 32 | 32 | |
| Diameter (mm) | 4.12 | — | 4.12 | 4.10 | |
| Depth (mm) | 0.19 | — | 0.19 | 0.20 | |
| Volume ($mm^3$) | 1.29 | — | 1.29 | 1.16 | |
| Position of inflection point (%) | 88 | — | 88 | 73 | |
| Dimple (5) | | | | | |
| Dimple number | 16 | — | 16 | 16 | |
| Diameter (mm) | 3.88 | — | 3.88 | 4.10 | |
| Depth (mm) | 0.18 | — | 0.18 | 0.20 | |
| Volume ($mm^3$) | 1.02 | — | 1.02 | 1.05 | |
| Position of inflection point (%) | 85 | — | 85 | 70 | |
| Dimple (6) | | | | | |
| Dimple number | 16 | 16 | 16 | 16 | |
| Diameter (mm) | 3.30 | 3.30 | 3.30 | 3.32 | |
| Depth (mm) | 0.16 | 0.16 | 0.16 | 0.13 | |
| Volume ($mm^3$) | 0.52 | 0.52 | 0.52 | 0.42 | |
| Position of inflection point (%) | nil | nil | nil | nil | |
| Total dimple number | 392 | 392 | 392 | 392 | — |
| Total dimple volume ($mm^3$) | 324.7 | 316.6 | 324.7 | 316.5 | — |
| $V_a$ (%) | 0.80 | 0.78 | 0.80 | 0.78 | — |
| Ball diameter (mm) | 42.7 | 42.7 | 42.7 | 42.7 | 42.7 |
| Ball weight (g) | 45.3 | 45.4 | 45.5 | 45.3 | 45.3 |
| Ball $\mu$ hardness (mm) | 2.9 | 2.9 | 2.7 | 2.9 | 2.6 |
| Flight | | | | | |
| Head speed 50 m/s, driver | | | | | |
| Initial velocity (m/s) | 71.9 | 71.9 | 72.3 | 71.9 | 72.9 |
| Spin (rpm) | 2400 | 2400 | 2250 | 2400 | 2800 |
| Elevation angle (°) | 9 | 9.1 | 8.8 | 9.1 | 9.2 |
| Symmetry (m) | 0 | 0.4 | 0.1 | 0.2 | 0.7 |

TABLE 2-continued

| | Example 1 | Example 2 | Example 3 | Comparative Example 1 | Comparative Example 2 |
|---|---|---|---|---|---|
| Carry (m) | 224.7 | 222.8 | 227.5 | 223.9 | 225.1 |
| Carry standard deviation (m) | 1.5 | 3.5 | 1.3 | 1.8 | 3.9 |
| Total (m) | 254.5 | 250.7 | 255.4 | 247.3 | 249.2 |
| Head speed 38 m/s, No. 5 iron | | | | | |
| Initial velocity (m/s) | 52.6 | 52.6 | 52.8 | 52.6 | 52.1 |
| Spin (rpm) | 6400 | 6400 | 5700 | 6400 | 6600 |
| Elevation angle (°) | 19.2 | 19.5 | 19 | 19.9 | 18.9 |
| Symmetry (m) | 0.1 | 0.6 | 0 | 0.1 | 0.9 |
| Carry (m) | 159.4 | 157.9 | 161.3 | 155.4 | 151.4 |
| Carry standard deviation (m) | 0.8 | 2.2 | 1.1 | 1.7 | 2.7 |
| Total (m) | 166.3 | 164.5 | 169.2 | 163.1 | 155.7 |
| Head speed 19 m/s, sand wedge | | | | | |
| Initial velocity (m/s) | 17.6 | 17.6 | 18.2 | 17.6 | 17.1 |
| Spin (rpm) | 6200 | 6200 | 5700 | 6200 | 6000 |

What is claimed is:

1. A solid golf ball having a plurality of dimples formed in its surface, characterized in that at least 70% of the entire dimples have a point of inflection at a position of 75 to 90% of their depth, wherein the depth is equal to a distance from a straight line segment connecting edges of the dimples to a deepest bottom of the dimples, and a proportion of a sum of dimple space volumes to a volume of the ball is 0.7 to 0.9%.

2. The solid golf ball of claim 1 having dimples of at least three types which are different in diameter and dimples of at least two types which are identical in diameter, but different in depth, wherein the total number of dimples is 360 to 540.

3. The solid golf ball of claim 1 comprising a solid core formed of a rubber composition to a diameter of 34 to 40 mm and a cover enclosing the core.

4. The solid golf ball of claim 3 wherein the cover has an inside cover of 1.0 to 2.0 mm thick and an outside cover of 1.0 to 2.0 mm thick, the outside cover formed of a thermoplastic polyurethane elastomer.

5. The solid golf ball of claim 1, wherein said dimples having a point of inflection at a position of 75 to 90% of their depth are configured by joining a downwardly convex first dimple portion to a downwardly convex second dimple portion such that both the portions are smoothly connected at a joint.

6. The solid golf ball of claim 1, wherein the total number of dimples is at least 380.

7. The solid golf ball of claim 1, wherein the total number of dimples is at most 400.

8. The solid golf ball of claim 1, wherein the dimple surface coverage is 69 to 82%.

9. The solid golf ball of claim 1, wherein the dimple surface coverage is 72 to 77%.

10. The solid golf ball of claim 1, wherein said overall dimple volume proportion is 0.75 to 0.82%.

11. The solid golf ball of claim 1, wherein said dimples have a point of inflection at a position of at least 80% and up to 90% of their depth.

* * * * *